US012760397B2

(12) United States Patent
Philippot et al.

(10) Patent No.: US 12,760,397 B2
(45) Date of Patent: Oct. 13, 2026

(54) HIGH TOUGHNESS PRESS-HARDENED STEEL PART AND METHOD OF MANUFACTURING THE SAME

(71) Applicant: ArcelorMittal, Luxembourg (LU)

(72) Inventors: Clément Philippot, Ennery (FR); Alice Dumont, Le Ban St Martin (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 19/178,261

(22) Filed: Apr. 14, 2025

(65) Prior Publication Data

US 2025/0243573 A1 Jul. 31, 2025

Related U.S. Application Data

(63) Continuation of application No. PCT/IB2023/061431, filed on Nov. 13, 2023.

(30) Foreign Application Priority Data

Nov. 14, 2022 (WO) ..... PCT/IB2022/060923

(51) Int. Cl.

| | |
|---|---|
| ***C22C 38/38*** | (2006.01) |
| ***C21D 1/18*** | (2006.01) |
| ***C21D 8/02*** | (2026.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/28*** | (2006.01) |
| ***C22C 38/32*** | (2006.01) |

(52) U.S. Cl.

CPC ..... *C22C 38/38* (2013.01); *C21D 1/18* (2013.01); *C21D 8/02* (2013.01); *C21D 8/0236* (2013.01); *C21D 9/46* (2013.01); *C22C 38/008* (2013.01); *C22C 38/02* (2013.01); *C22C 38/06* (2013.01); *C22C 38/20* (2013.01); *C22C 38/28* (2013.01); *C22C 38/32* (2013.01); *C21D 2211/003* (2013.01); *C21D 2211/005* (2013.01); *C21D 2211/008* (2013.01); *C21D 2211/009* (2013.01)

(58) Field of Classification Search

None

See application file for complete search history.

(56) References Cited

U.S. PATENT DOCUMENTS

| | | | |
|---|---|---|---|
| 2015/0007911 | A1 | 1/2015 | Murakami et al. |
| 2016/0312331 | A1 | 10/2016 | Cho et al. |
| 2017/0037488 | A1 | 2/2017 | Hasegawa et al. |
| 2018/0135145 | A1 | 5/2018 | Suwa et al. |
| 2018/0223409 | A1* | 8/2018 | Allely ..... C22C 21/00 |
| 2020/0172991 | A1* | 6/2020 | Takashima ..... C23C 2/40 |
| 2020/0190615 | A1 | 6/2020 | Toyoda et al. |
| 2020/0263283 | A1 | 8/2020 | Schulz et al. |
| 2022/0213573 | A1 | 7/2022 | Siebentritt et al. |
| 2022/0275493 | A1 | 9/2022 | Yokohama et al. |
| 2022/0298614 | A1 | 9/2022 | Siebentritt et al. |
| 2024/0218490 | A1 | 7/2024 | Liu et al. |

FOREIGN PATENT DOCUMENTS

| | | | |
|---|---|---|---|
| CN | 114107788 | A | 3/2022 |
| EP | 2631307 | A1 | 8/2013 |
| EP | 2708613 | A1 | 3/2014 |
| EP | 3854900 | A1 | 7/2021 |
| EP | 3859040 | A1 | 8/2021 |
| EP | 4067512 | A1 | 10/2022 |
| JP | 2011052320 | A | 3/2011 |
| WO | WO2016163469 | A1 | 10/2016 |
| WO | WO2018186274 | A1 | 10/2018 |
| WO | WO2020239905 | A1 | 12/2020 |
| WO | WO2021084378 | A1 | 5/2021 |
| WO | WO2022129994 | A1 | 6/2022 |
| WO | WO2022129995 | A1 | 6/2022 |
| WO | WO2022228574 | A1 | 11/2022 |
| WO | WO2022234319 | A1 | 11/2022 |
| WO | WO2022234320 | A1 | 11/2022 |
| WO | WO2024/105535 | A2 | 5/2024 |

OTHER PUBLICATIONS

Press Hardened Steels Published on Oct. 6, 2022 (Year: 2022).*
U.S. Appl. No. 19/178,276, filed Apr. 14, 2025.

* cited by examiner

*Primary Examiner* — Jenny R Wu
(74) *Attorney, Agent, or Firm* — Davidson Kappel LLC

(57) ABSTRACT

A steel sheet and press hardened steel part having a composition including, by weight percent: C 0.05-0.4%, Mn 0.5-4%, Si 0.1-1.3%, Al 0.01-0.1%, Cr 0.01-1.0%, Ti 0.01-0.1%, B 0.0005-0.08%, Cu 0.05-0.4%, Sn 0.002-0.1%, P≤0.020%, S≤0.010%, N≤0.02% the remainder of the composition being iron and unavoidable impurities resulting from the smelting process and depending on the process route. The press hardened steel part has a microstructure including, in surface fraction, more than 95% of martensite, the rest being optional bainite and retained austenite.

10 Claims, No Drawings

HIGH TOUGHNESS PRESS-HARDENED STEEL PART AND METHOD OF MANUFACTURING THE SAME

This is a continuation of International Patent Application PCT/IB2023/061431, filed on Nov. 13, 2023, published as WO 2024/105531 A2, and claims priority to International Patent Application PCT/IB2022/060923, filed on Nov. 14, 2022. All of the above are hereby incorporated by reference herein.

The present invention relates to a high strength press hardened steel part with high toughness.

BACKGROUND

High strength press-hardened parts can be used as structural elements in automotive vehicles for anti-intrusion or energy absorption functions.

SUMMARY OF THE INVENTION

In such type of applications, it is desirable to produce steel parts that combine high mechanical strength, high impact resistance and good corrosion resistance. Moreover, one of major challenges in the automotive industry is to decrease the weight of vehicles in order to improve their fuel efficiency in view of global environmental conservation efforts, without neglecting the safety requirements, including in the harshest environments.

This weight reduction can be achieved in particular thanks to the use of steel parts with a martensitic or bainitic/martensitic microstructure.

The publication WO2016163469 relates to a martensitic heat-treated steel sheet member that has a good scale property and a high yield strength and is excellent in toughness. The steel part having toughness higher than 35 J/cm$^2$ (0.35 J/mm$^2$), measured by Charpy impact test at −80° C., is considered to be excellent in toughness. Nevertheless, none of the steel part reaches a toughness value higher than 55 J/cm$^2$ (0.55 J/mm$^2$), which could lead to parts that fracture at high stress.

It is an object of the present invention to solve the above-mentioned problem and to provide a press hardened steel part having a high toughness, with an average Charpy impact values calculated as the average of the Charpy impact energy values measured at 20° C., −40° C., −60° C. and −80° C., above or equal to 0.90 J/mm$^2$.

Preferably, the press hardened steel part according to the invention has a Charpy impact energy measured at −80° C., above or equal to 0.75 J/mm$^2$.

Preferably, the press hardened steel part according to the invention has a loss of ductility Δ between the Charpy impact energy measured at 20° C. and the Charpy impact energy measured at −80° C. lower than 25%.

Another purpose of the invention is to obtain a steel sheet that can be transformed by hot forming into such a press hardened steel part.

The present invention provides a steel sheet made of a steel having a composition comprising, by weight percent:

C: 0.05–0.4%

Mn: 0.5–4%

Si: 0.1–1.3%

-continued

Al: 0.01–0.1%

Cr: 0.01–1.0%

B: 0.0005–0.08%

Ti: 0.01–0.1%

Cu: 0.05–0.4%

Sn: 0.002–0.1%

P ≤ 0.020%

S ≤ 0.010%

N ≤ 0.02% and comprising optionally one or more of the following elements, by weight percent:

Ni ≤ 0.4%

Mo ≤ 0.40%

Nb ≤ 0.08%

Ca ≤ 0.1% the remainder of the composition being iron and unavoidable impurities resulting from the smelting, said steel sheet having a microstructure comprising, in surface fraction, 50% or more of ferrite, the rest being pearlite or cementite.

The present invention also provides a process for manufacturing a press hardened steel part comprising the following successive steps:

providing a steel sheet as described above, cutting said steel sheet to a predetermined shape, so as to obtain a steel blank, heating the steel blank to a temperature $T_1$ from 800° C. to 980° C. and maintaining at said $T_1$ temperature during a dwell time $t_1$ of 10 s to 900 s to obtain a heated steel blank, transferring the heated steel blank to a forming press, hot-forming the heated steel blank in the forming press to obtain a formed part, die-quenching the formed part.

The present invention also provides a press hardened steel part made of a steel as described above, said steel part having a microstructure comprising, in surface fraction, more than 95% of martensite, the rest being optional bainite and retained austenite.

The present invention also provides process for manufacturing a martensitic steel sheet comprising the following successive steps:

providing a steel sheet as described above, optionally annealing the steel sheet to an annealing temperature T from 500° C. to 750° C. and maintaining at said annealing temperature for a holding time t of 300 s to 80 h optionally cold rolling the steel sheet annealing the steel sheet to a temperature $T_1$ from 800° C. to 980° C. and maintaining at said $T_1$ temperature for a holding time $t_1$ of 10 s to 900 s, cooling the steel sheet below Ms, optionally reheating the steel sheet to a temperature from 150° C. to 270° C. and maintaining at said temperature for a holding time of 1 s to 600 s, cooling the steel sheet to room temperature, to obtain a martensitic steel sheet having a microstructure comprising, in surface fraction, more than 95% of martensite, the rest being optional bainite and retained austenite.

DETAILED DESCRIPTION

The invention will now be described in detail and illustrated by examples without introducing limitations.

The composition of the steel sheet according to the invention will now be described, the content being expressed in weight percent (wt. %).

According to the invention the carbon content is from 0.05% to 0.4% to ensure a satisfactory strength. Above 0.4% of carbon, weldability and bendability of the steel may be reduced. If the carbon content is lower than 0.05%, the tensile strength will be too low.

The manganese content is from 0.5% to 4%. Above 4% of addition, the risk of central segregation increases to the detriment of the toughness. Below 0.5% the hardenability of the steel is reduced. Preferably the manganese content is from 0.8% to 2%, more preferably from 0.8% to 1.6%.

According to the invention, silicon content is from 0.1% to 1.3%. Silicon is an element participating in the hardening in solid solution. Silicon is added to limit carbides formation. Above 1.3%, silicon is detrimental for toughness. Moreover, silicon oxides form at the surface, which impairs the coatability of the steel, and the weldability of the steel sheet and steel part may be reduced. Preferably, the silicon content is from 0.1% to 1%, more preferably, from 0.1% to 0.5%, even more preferably from 0.1% to 0.4%.

The aluminum content is from 0.01% and 0.1% as it is a very effective element for deoxidizing the steel in the liquid phase during elaboration. Aluminum can protect boron if titanium content is not enough. The aluminum content is lower than 0.1% to avoid oxidation problems and ferrite formation during press hardening. Preferably the aluminum content is from 0.01% to 0.05%.

According to the invention, the chromium content is from 0.01% to 1.0%. Chromium is an element participating in the hardenability of the steel sheet and must be higher than 0.01%. The chromium content is below 1.0% to limit processability issues and cost.

According to the invention, the boron content is from 0.0005% to 0.08%. Boron improves the hardenability of the steel. The boron content is not higher than 0.08% to avoid a risk of breaking the slab during continuous casting.

The titanium content is from 0.01% to 0.1% in order to protect boron from formation of BN. Titanium content is limited to 0.1% to avoid TIN formation. In a preferred embodiment, Ti/N>3.42 for the boron protection.

According to the invention, the copper content is from 0.05 to 0.4% in order to increase the toughness of the steel part. Copper content is limited to 0.4% in order to limit the hot shortness risk which may weaken the slab. Preferably, the copper content is from 0.05 to 0.25%, more preferably from 0.07% to 0.25%. More preferably the copper content is from 0.08% to 0.25%, even more preferably from 0.08% to 0.20%. More preferably the copper content is from 0.08% to 0.18%.

The tin content is from 0.002% to 0.1% to improve hardenability of the steel. Above 0.1%, tin can emphasize the risk of hot shortness and limit the processability of slabs. Preferably, the tin content is from 0.002% to 0.050%.

Preferably, the sum of copper and tin contents is from 0.08% to 0.3%, more preferably from 0.09% to 0.3%, even more preferably from 0.1% to 0.3%.

Some elements can optionally be added.

Nickel can be added up to 0.4% to limit hydrogen intake of the steel during its production and limiting the risk of delayed fracture due to hydrogen embrittlement.

The nickel content is considered as a residual element up to 0.020%. Preferably, if added, the nickel content is up to 0.1%, more preferably up to 0.05%.

Molybdenum content can optionally be added up to 0.40%. As boron, molybdenum improves the hardenability of the steel. Molybdenum is not higher than 0.40% to limit cost.

Niobium can optionally be added up to 0.08% to improve ductility of the steel. Above 0.08% of addition, the risk of formation of NbC or Nb(C,N) carbides increases to the detriment of the bendability. Preferably the niobium content is below or equal to 0.05%.

Calcium may be also added as an optional element up to 0.1% and preferably in a minimal amount of 0.0001%. Addition of Ca at the liquid stage makes it possible to create fine oxides which promote castability of continuous casting. Moreover, calcium can help to limit the formation of detrimental MnS by promoting the formation of CaO—CaS.

The remainder of the composition of the steel is iron and unavoidable impurities resulting from the smelting process and depending on the process route. In the case of a production route using a blast furnace, the level of unavoidable impurities is very low. In the case of a production route using an Electric Arc Furnace loaded with scraps, the steel sheet can further comprise residual elements coming from such scraps such as Antimony, Arsenic and Lead, up to 0.03% which are considered as unavoidable impurities.

P, S and N are also part of the unavoidable impurities whatever the process route. Their content is less than or equal to 0.010% for S, less than or equal to 0.020% for P and less than or equal to 0.02% for N.

In a particular embodiment, the steel sheet has a chemical composition comprising the following elements expressed in weight percent:

C: 0.062–0.095%

Mn: 1.4–1.9%

Si: 0.2–0.5%

Al: 0.020–0.070%

Cr: 0.02–0.1%

Wherein $1.5\% \leq (C + Mn + Si + Cr) \leq 2.7$

Nb: 0.040–0.060%

Ti: 0.01–0.1%

B: 0.0005–0.004%

Cu: 0.05–0.4%

Sn: 0.002–0.1%

$S \leq 0.003\%$ $P \leq 0.020\%$ $N \leq 0.009\%$ and comprising optionally one or more of the following elements, in weight percent:

$$0.0001 \leq Ca \leq 0.003\%$$

the remainder of the composition being iron and unavoidable impurities resulting from the smelting process and depending on the process route.

In another particular embodiment, the steel sheet has a chemical composition comprising the following elements expressed in weight percent:

C: 0.15–0.4%

Mn: 0.5–3%

Si: 0.1–0.5%

Cr 0.01–1%

Ti 0.01–0.1%

Al 0.01–0.1%

B: 0.0005–0.08%

Cu: 0.05–0.4%

Sn: 0.002–0.1%

S ≤ 0.010%

P ≤ 0.020%

N ≤ 0.02% the remainder of the composition being iron and unavoidable impurities resulting from the smelting process and depending on the process route.

In another particular embodiment, the steel sheet has a chemical composition comprising the following elements expressed in weight percent:

C: 0.15–0.25%

Mn: 0.5–1.8%

Si: 0.1–1.25%

Cr 0.1–1%

Ti 0.01–0.1%

Al 0.01–0.1%

B: 0.001–0.004%

Cu: 0.05–0.4%

Sn: 0.002–0.1%

S ≤ 0.010%

P ≤ 0.020%

N ≤ 0.02% and comprising optionally one or more of the following elements, by weight percent:

Mo ≤ 0.40%

Nb ≤ 0.08%

-continued

Ca ≤ 0.1% the remainder of the composition being iron and unavoidable impurities resulting from the smelting process and depending on the process route.

In another particular embodiment, the steel sheet has a chemical composition comprising the following elements expressed in weight percent:

C: 0.24–0.4%

Mn: 0.5–3%

Si: 0.10–1.3%

Al: 0.015–0.070

Cr: 0.1–1.0%

Ni: 0.25–0.4%

Nb: 0–0.060%

B: 0.0005–0.0040

Cu: 0.05–0.4%

Sn: 0.002–0.1%

S ≤ 0.010%

P ≤ 0.020%

N ≤ 0.02%

Ti 0.01–0.1%

$$2.6 + (Mn/5.3) + (Cr/13) + (Si/15) > 1.1\%$$

and comprising optionally one or more of the following elements, by weight percent:

Mo: 0.05–0.40%

Ca 0.0005–0.005% the remainder of the composition being iron and unavoidable impurities resulting from the smelting process and depending on the process route.

In another particular embodiment, the steel sheet has a chemical composition comprising the following elements expressed in weight percent:

C: 0.3–0.4%

Mn: 0.5–1.0%

Si: 0.4–0.8%

Cr: 0.1–1.0%

Mo: 0.1–0.4%

Nb: 0.01–0.08%

Al: 0.01–0.1%

Cu: 0.05–0.4%

Sn: 0.002–0.1%

Ti: 0.01–0.03%

-continued

B: 0.0005–0.003%

$P \leq 0.020\%$ $Ca \leq 0.0010\%$ $S \leq 0.010\%$ $N \leq 0.02\%$

And comprising optionally:

$Ni < 0.4\%$ the remainder of the composition being iron and unavoidable impurities resulting from the smelting process and depending on the process route.

The steel sheet according to the invention can be produced by any appropriate manufacturing method and the man skilled in the art can define one. It is however preferred to use the method according to the invention comprising the following steps:

A semi-product able to be further hot rolled, is provided with the steel composition described above. Such semi-product can for example be a slab.

The semi product is obtained by casting liquid steel, which can be produced by a steelmaking process using for example the Basic Oxygen Furnace (BOF) route. In BOF route, hot metal or pig iron obtained for example in a blast furnace or a smelting furnace, is decarburized to be turned into liquid steel. Optionally, ferrous scraps comprising elements such as copper, nickel, chromium, molybdenum, tin, arsenic, antimony, or lead are loaded in the furnace together with this hot metal or pig iron. Direct Reduced Iron (DRI) may also be charged.

The liquid steel can also be produced in an Electric Arc Furnace (EAF) by melting ferrous scraps to directly produce liquid steel. DRI may also be charged together with ferrous scrap in the EAF.

The semi product is heated to a temperature from 1100° C. to 1300° C. The steel sheet is then hot rolled at a finish hot rolling temperature (FRT) from 830° C. to 950° C. Preferably, the FRT is comprised from 850° C. to 950° C. The hot-rolled steel is then cooled and coiled at a temperature lower than 670° C., and optionally pickled to remove oxidation.

In one preferred embodiment of the invention the hot rolled steel sheet is then cooled to room temperature.

In another preferred embodiment, the hot rolled steel sheet is annealed to an annealing temperature $T_A$ from 700° C. to 850° C. and maintained at said annealing temperature $T_A$ for a holding time $t_a$ of 10 s to 1200 s, and optionally coated with an aluminum coating, or aluminum alloy coating, or zinc coating or zinc alloy coating and cooled down to room temperature.

In another preferred embodiment of the invention, the hot rolled steel sheet is cold rolled and annealed to an annealing temperature $T_A$ from 700° C. to 850° C. and maintained at said annealing temperature $T_A$ for a holding time $t_a$ of 10 s to 1200 s, and optionally coated with an aluminum coating, or aluminum alloy coating, or zinc coating or zinc alloy coating and cooled down to room temperature.

In another preferred embodiment of the invention, the hot rolled steel sheet is cold rolled and annealed to an annealing temperature $T_A$ from 500° C. to 750° C. and maintained at said annealing temperature $T_A$ for a holding time $t_a$ of 300 s to 80 h, in order to obtain an annealed steel sheet.

The microstructure of the steel sheet according to the invention comprises 50% or more of ferrite in surface fraction, the rest being pearlite or cementite.

The steel part according to the invention can be produced by any appropriate manufacturing method and the man skilled in the art can define one. It is however preferred to use the method according to the invention comprising the following steps:

A steel sheet having the above chemical composition and microstructure is provided and cut to a predetermined shape, so as to obtain a steel blank.

The steel blank is then heated to a temperature $T_1$ from 800° C. to 980° C. and maintained at said $T_1$ temperature for a dwell time $t_1$ of 10 s to 900 s to obtain a heated steel blank. The heated steel blank is then transferred to a forming press, and hot formed. After hot forming, the steel part is then die-quenched.

The microstructure of the steel part according to the invention will now be described.

During the heating of the steel blank cut out of the steel sheet, all microstructural elements are transformed into austenite. The heated blank is then transferred to a forming press, and hot formed. After hot forming, the steel part is then die-quenched, austenite being transformed in more than 95% of martensite, the rest being optional bainite and retained austenite. Preferably, the microstructure comprised more than 98% of martensite, the rest being optional bainite and retained austenite.

The press hardened steel part according to the invention has an average Charpy impact energy value calculated as the average of the Charpy impact energy values measured at 20° C., −40° C., −60° C. and −80° C., above or equal to 0.90 $J/mm^2$. Preferably, this average value is above or equal to 0.95 $J/mm^2$.

The toughness is measured by Charpy impact energy at 20° C., −40° C., −60° and −80° C. according to Standard ISO 148-1:2006 (F) and ISO 148-1: 2017 (F).

Preferably, the press hardened steel part has a Charpy impact energy at −80° C. higher than 0.75 $J/mm^2$.

Preferably, the press hardened steel part according to the invention has a loss of ductility Δ between the Charpy impact energy measured at 20° C. and the Charpy impact energy measured at −80° C. lower than 25%.

Preferably, the press hardened steel part has a tensile strength TS above or equal to 950 MPa. More preferably, the press hardened steel part has TS above or equal to 1350 MPa. TS is measured according to Standard ISO 6892-1.

In a preferred embodiment of the invention, a martensitic steel sheet can be produced by a method comprising the following steps: the hot rolled steel sheet having the above chemical composition is provided and optionally annealed to a temperature T from 500° C. to 750° C. and maintained at said annealing temperature for a holding time t of 300 s to 80 h and optionally cold rolled. The steel sheet is then annealed to a temperature $T_1$ comprised from 800° C. to 980° C. during $t_1$ comprised from 10 s to 900 s, and cooled below Ms. The steel sheet is optionally reheated to a temperature from 150° C. and 270° C. and maintained at said temperature for a holding time of 1 s to 600 s, before being cooled to room temperature to obtain a martensitic steel sheet having a microstructure comprising more than 95% of martensite, the rest being optional bainite and retained austenite.

Preferably, this martensitic steel sheet has an average Charpy impact energy value calculated as the average of the Charpy impact energy values measured at 20° C., −40° C., −60° C. and −80° C., above or equal to 0.90 J/mm$^2$. Preferably, this average value is above or equal to 0.95 J/mm$^2$.

Preferably, the martensitic steel sheet has a Charpy impact energy at −80° C. higher than 0.75 J/mm$^2$.

Preferably, the martensitic steel sheet has a loss of ductility Δ between the Charpy impact energy measured at 20° C. and the Charpy impact energy measured at −80° C. lower than 25%.

Preferably, the martensitic steel sheet has a tensile strength TS above or equal to 950 MPa. More preferably, the martensitic steel sheet has TS above or equal to 1350 MPa.

The invention will be now illustrated by the following examples, which are by no way limitative.

Example 5 grades, which compositions are gathered in table 1, were cast in semi-products and processed into steel sheets, then steel parts, following the process parameters gathered in table 3.

Table 1—Compositions

The tested compositions are gathered in the following table wherein the element contents are expressed in weight percent (wt. %).

| Steel | C | Mn | Si | Al | Cr | Ti | B | Cu | Sn | Ni | P | S | IN |
|---|---|---|---|---|---|---|---|---|---|---|---|---|---|
| A | 0.23 | 1.19 | 0.25 | 0.03 | 0.18 | 0.034 | 0.0025 | 0.12 | 0.003 | 0.015 | 0.013 | 0.0013 | 0.0038 |
| B | 0.23 | 1.21 | 0.26 | 0.04 | 0.19 | 10.037 | 0.0021 | 0.09 | 0.031 | 0.014 | 0.014 | 0.0011 | 0.0054 |
| C | 0.23 | 1.14 | 0.26 | 0.04 | 0.18 | 0.040 | 0.0025 | 0.01 | 0.005 | 0.015 | 0.013 | 0.0020 | 0.0043 |
| D | 0.23 | 1.18 | 0.25 | 0.03 | 0.18 | 0.037 | 0.0024 | 0.02 | 0.018 | 0.014 | 0.016 | 0.0012 | 0.0054 |
| E | 0.22 | 1.20 | 10.25 | 0.03 | 0.18 | 0.037 | 0.0023 | 0.04 | 0.012 | 0.017 | 0.012 | 0.0013 | 0.0046 |

Steels A-B are according to the invention, C-E are references.
Underlined values: not corresponding to the invention Table 2—Microstructure of the steel sheets Steel semi-products, as cast, were reheated at 1200° C., hot rolled with a finish hot rolling temperature of 890° C. and coiled at 550° C. The microstructure of the steel sheets expressed in surface fraction, are gathered in the following table:

| Trial | Steel | Ferrite (%) | Pearlite (%) |
|---|---|---|---|
| 1 | A | 75 | 25 |
| 2 | B | 70 | 30 |
| 3 | C | 73 | 27 |
| 4 | D | 73 | 27 |
| 5 | E | 73 | 27 |

The surface fractions are determined through the following method: a specimen is cut from the steel sheet, polished and etched with a reagent known per se, to reveal the microstructure. The section is afterwards examined through optical.

Table 3—Process Parameters

The steel sheets were then cut to obtain a steel blank, heated to a temperature $T_1$ and maintained at said temperature for a dwell time $t_1$ and hot-formed. The following specific conditions were applied:

| Trial | $T_1$(° C.) | $t_1$ (s) |
|---|---|---|
| 1 | 920 | 575 |
| 2 | 920 | 575 |
| 3 | 920 | 540 |
| 4 | 900 | 540 |
| 5 | 900 | 600 |

Underlined values: not corresponding to the invention

The steel parts were analyzed and the corresponding microstructure, is gathered in table 4. Mechanical properties are gathered in Table 5.

TABLE 4

Microstructure of the press hardened steel part

| Trial | Martensite |
|---|---|
| 1 | 100% |
| 2 | 100% |
| 3 | 100% |
| 4 | 100% |
| 5 | 100% |

The surface fractions are determined through the following method: a specimen is cut from the press hardened steel part, polished and etched with a reagent known per se, to reveal the microstructure. The section is afterwards examined through optical or scanning electron microscope, for example with a Scanning Electron Microscope with a Field Emission Gun ("FEG-SEM") at a magnification greater than 5000x, coupled to a EBSD (Electron Back Scattered Diffraction) device.

Table 5—Mechanical properties of the press hardened steel part

The toughness of the parts was measured by Charpy impact test at four temperatures $T_{test}$ 20° C., −40° C., −60° and −80° C., and gathered in the following table. The average Charpy impact energy value is calculated by an average of the four toughness values. The loss of ductility Δ between 20° C. and −80° C. is calculated by the difference between the Charpy impact energy measured at 20° C. and the Charpy impact energy measured at −80° C.

| Trial | $T_{test}$ (° C.) | Charpy value (J/mm$^2$) | Average Charpy impact (J/mm$^2$) | Δ (%) | TS (MPa) |
|---|---|---|---|---|---|
| 1 | 20 | 1.06 | 1.00 | 19 | 1491 |
| | −40 | 1.08 | | | |
| | −60 | 0.98 | | | |
| | −80 | 0.87 | | | |
| 2 | 20 | 1.09 | 0.98 | 24 | 1486 |
| | −40 | 1.00 | | | |
| | −60 | 0.96 | | | |
| | −80 | 0.85 | | | |
| 3 | 20 | 1.04 | 0.86 | 45 | 1513 |

-continued

| Trial | $T_{test}$ (° C.) | Charpy value (J/mm²) | Average Charpy impact (J/mm²) | Δ (%) | TS (MPa) |
|---|---|---|---|---|---|
| | −40 | 0.92 | | | |
| | −60 | 0.89 | | | |
| | −80 | 0.59 | | | |
| 4 | 20 | 0.91 | 0.71 | 49 | 1501 |
| | −40 | 0.84 | | | |
| | −60 | 0.65 | | | |
| | −80 | 0.42 | | | |
| 5 | 20 | 1.01 | 0.87 | 29 | 1541 |
| | −40 | 0.93 | | | |
| | −60 | 0.82 | | | |
| | −80 | 0.72 | | | |

Underlined values: do not match the targeted value

The examples show that the steel parts according to the invention, namely trials 1 and 2 are the only ones to show the targeted property, thanks to their specific compositions and microstructures.

The steel part of trial 3 has a chemical composition similar to the steel part of trial 1, except a lower level of copper. At the same Charpy test temperature, the toughness of trial 3 is much lower than trial 1. The lower the temperature at which the Charpy impact is measured, the greater the difference of toughness between the two trials. This can be evidenced by the average Charpy impact energy value, calculated by an average of the four toughness values. The higher the average, the higher the toughness.

Moreover, the copper content according to the invention allows to shift the ductile-to-brittle transition temperature (DBTT) to lower temperatures. This DBTT is the temperature at which a ductile material becomes brittle. This shift of the DBTT can be evidenced by the average Charpy impact energy value. The higher the average value, the more the DBTT is shifted to low temperature.

Trials 4 and 5 concern steel parts with low levels of copper. The average Charpy impact energy value is lower than 0.90 J/mm², meaning that the toughness of the steel part is low, and the DBTT is high.

What is claimed is:

1. A press hardened steel part made of steel having a composition comprising, by weight percent:

C: 0.062 – 0.095%

Mn: 1.4 – 1.9%

Si: 0.2 – 0.5%

Al: 0.020 – 0.070%

Cr: 0.02 – 0.1% wherein $1.5\% \leq (C + Mn + Si + Cr) \leq 2.7$

Nb: 0.040 – 0.060%

Ti: 0.01 – 0.1%

B: 0.0005 – 0.004%

-continued

Cu: 0.05 – 0.4%

Sn: 0.002 – 0.1%

$S \leq 0.003\%$ $P \leq 0.020\%$ $N \leq 0.009\%$ and comprising optionally one or more of the following elements, in weight percent:

$0.0001 \leq Ca \leq 0.003\%$ a remainder of the composition being iron and unavoidable impurities resulting from processing, the steel part having a microstructure comprising, in surface fraction, more than 95% of martensite, a rest being optional bainite and/or optional retained austenite, the steel part having a tensile strength TS of between 950 and 1491 MPa.

2. The press hardened steel part as recited in claim 1 wherein the press hardened steel part has an average Charpy impact energy value, calculated as the average of Charpy impact energies measured at 20° C., −40° C., −60° C. and −80° C., that is above or equal to 0.90 J/mm².

3. The press hardened steel part as recited in claim 1 wherein the press hardened steel part has a Charpy impact energy measured at −80° C. higher than 0.75 J/mm².

4. The press hardened steel part as recited in claim 1 wherein the press hardened steel part has a loss of ductility Δ between the Charpy impact energy measured at 20° C. and the Charpy impact energy measured at −80° C. lower than 25%.

5. The press hardened steel part as recited in claim 1, wherein the microstructure comprises more than 98% of martensite.

6. The press hardened steel part as recited in claim 1 wherein Cu: 0.08-0.25% in weight percent.

7. The press hardened steel part as recited in claim 1 wherein Cu: 0.08-0.20% in weight percent.

8. The press hardened steel part as recited in claim 1 wherein Cu: 0.08-0.18% in weight percent.

9. The press hardened steel part as recited in claim 1 wherein Cu: 0.09-0.12% in weight percent.

10. A process for manufacturing the press hardened steel part as recited in claim 1, the process comprising the following successive steps:

providing a steel sheet;

cutting the steel sheet to a predetermined shape, so as to obtain a steel blank;

heating the steel blank to a temperature $T_1$ from 800° C. to 980° C. and maintaining the steel blank at the temperature $T_1$ for a dwell time $t_1$ of 10 s to 900 s to obtain a heated steel blank;

transferring the heated steel blank to a forming press;

hot-forming the heated steel blank in the forming press to obtain a formed part; and die-quenching the formed part.

* * * * *